US005799672A

United States Patent [19]

Hansbury

[11] Patent Number: 5,799,672

[45] Date of Patent: Sep. 1, 1998

[54] HAIR RETAINING DEVICE

[76] Inventor: Barbara J. Hansbury, 9 Hobart Ave., Summit, N.J. 07901

[21] Appl. No.: 687,637

[22] Filed: Jul. 26, 1996

[51] Int. Cl.[6] ..... A45D 8/00

[52] U.S. Cl. ..... 132/273; 132/247

[58] Field of Search ..... 132/273, 246, 132/247, 275, 222, 262, 245

[56] References Cited

U.S. PATENT DOCUMENTS

| | | | |
|---|---|---|---|
| D. 345,644 | 4/1994 | Harvie . | |
| 347,177 | 8/1886 | Heysinger | 132/246 |
| 1,453,971 | 5/1923 | Calkins | 132/246 |
| 1,626,433 | 4/1927 | Siner . | |
| 1,908,970 | 5/1933 | Frankel | 132/246 |
| 2,402,795 | 6/1946 | Wipper et al. . | |
| 2,525,981 | 10/1950 | Webster | 132/246 |
| 2,795,232 | 6/1957 | Klein et al. | 132/275 |
| 3,204,646 | 9/1965 | Chamberlin | 132/250 |
| 3,566,886 | 3/1971 | Solomon | 132/262 |
| 3,624,749 | 11/1971 | Girard | 132/262 |
| 3,987,805 | 10/1976 | Schuster | 132/262 |
| 4,103,693 | 8/1978 | Reagan | 132/273 |
| 4,785,834 | 11/1988 | Gonzalez | 132/275 |
| 4,892,110 | 1/1990 | Harvie | 132/273 |
| 5,372,152 | 12/1994 | Dutch | 132/246 |
| 5,458,108 | 10/1995 | Jacobs | 132/273 |
| 5,538,021 | 7/1996 | Kim | 132/222 |
| 5,662,128 | 9/1997 | Habibi | 132/247 |

FOREIGN PATENT DOCUMENTS

| | | |
|---|---|---|
| 974419 | 2/1951 | France . |

*Primary Examiner*—Todd E. Manahan
*Assistant Examiner*—Eduardo C. Robert
*Attorney, Agent, or Firm*—William Squire

[57] ABSTRACT

A length of fabric or other sheet material for use as a decorative hair decorative has a pocket in which a conventional pipe cleaner, i.e., a ductile wire with a cushioning fiber covering, is secured. A gripping member is attached medially the length of fabric for gripping a hair bundle. The gripping member can comprise Velcro type hook member, high friction elastomeric material or other high friction material for securing the device to the hair to preclude sliding of the device off of the bundle. The pipe cleaner serves as a twist tie member so that the device ends can be quickly and easily secured and released from the hair bundle. The device is wrapped about the bundle and secured thereto with a twist of the device ends.

16 Claims, 3 Drawing Sheets

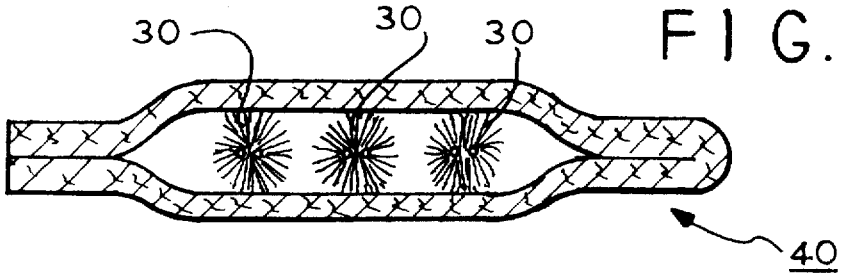
FIG. 11
FIG. 12
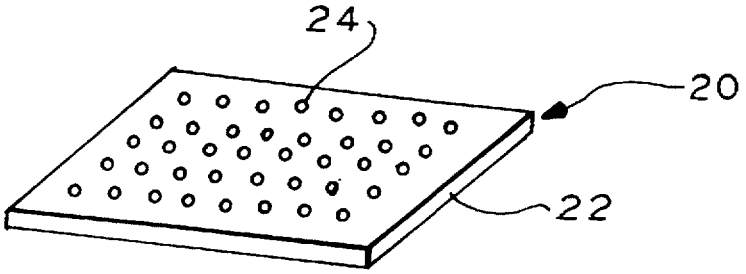
FIG. 13
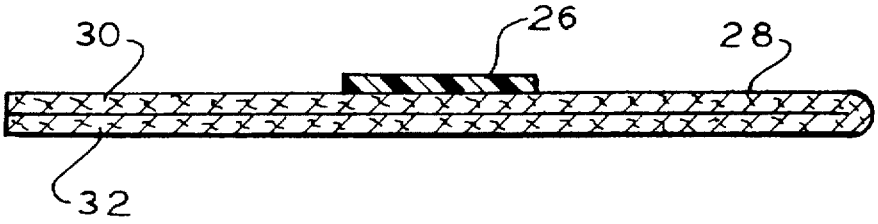

HAIR RETAINING DEVICE

This invention relates to hair retaining devices such as bows, barrettes and the like for decorating and retaining a length of hair in a bundle sometimes referred to as a pony tail.

Decorative hair retaining devices, some of which are referred to as hair wraps, are available in a wide assortment of arrangements. U.S. Pat. No. Des. 345,644 discloses one such wrap comprising a length of material stitched over itself in relatively thin layers forming an elongated narrow width device.

U.S. Pat. No. 4,892,110 discloses a hair wrap device comprising a flat ductile resistive metallic member capable of retain a coiled shape when coiled about a bundle of human hair. The metallic member is arranged on a backing member of about equal thickness to that of the metallic member. Metallic member and backing member form folded-over portions and a flat surface to which a cover member is attached. The backing material is resilient and has memory.

A further hair retaining structure is disclosed in U.S. Pat. No. 2,795,232. Disclosed is a hair retaining device comprising a fabric with a stretchable gathered portion using an elastic band. The gathered portion is described as resisting sliding along braided hair. The elastic band is bonded to the fabric and secured with tabs.

U.S. Pat. No. 1,626,433 discloses a head band formed of elastic material.

The present inventor recognizes a problem with the above devices and other devices of known configuration and materials. These prior art devices when wrapped about hair in bundles to form a pony tail, for example, tend to slide down the pony tail and disengage from the hair. The present inventor also recognizes a need for a device for forming a length of a bundle of hair quickly and easily without entanglement with the hair as occurs in some prior art devices, and yet retain its position on the hair without sliding off as occurs with prior art fabric type devices.

A hair retaining device according to the present invention for securing a length of hair in a bundle comprises a flexible material having a length for wrapping about the bundle and defined by first and second ends arranged to be releaseably tied together to secure the hair in the bundle. Hair gripping means are secured to the material intermediate the ends and comprise substantially a hair gripping surface for surface gripping the hair in the bundle to substantially resist sliding of the material along the bundle length.

In one embodiment, a ductile member is secured to the material to enable twist tying the ends together.

In a further embodiment, the gripping surface comprises a plurality of upstanding relatively stiff fibers secured to the material for gripping engagement with the hair in the bundle.

In another aspect of the present invention, the hair gripping means and surface comprises relatively high-friction means as compared to the friction of the material with the hair.

In another aspect, the hair gripping surface is formed from an elastomeric material and includes a plurality of raised projections.

BRIEF DESCRIPTION OF THE DRAWINGS

FIG. 11 is a sectional elevation view similar to the view of FIG. 4 of further embodiment of the present invention;

FIG. 12 is an isometric view of another aspect of the hair gripping device of the present invention; and FIG. 13 is a side elevation sectional view of a further embodiment of the present invention.

DETAILED DESCRIPTION OF THE PREFERRED EMBODIMENT

Figure 1:
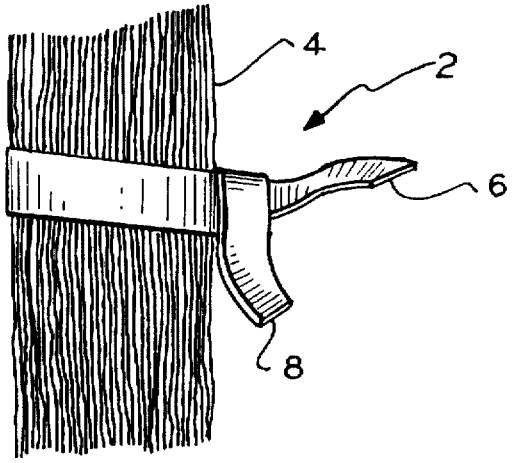
FIG. 1 is a side elevation view of a hair retaining device according to the present invention.

The device 2, FIG. 1, is wrapped about a bundle 4 of human hair. The bundle 4, for example, forms a so-called pony tail.

The device 2 comprises an elongated member 5 having a pair of opposite ends 6, 8 and a hair gripping member 10 secured to one side of the member 5. The member 5 may be single or multiple plies, one piece folded over upon itself or multiple bonded or stitched pieces. The member 5 is sufficiently long such that its ends 6 and 8 can be tied together, preferably by twist tying as will be explained below. However, in the alternative, the ends, if sufficiently long in a further embodiment, may be tied together by knotting or by tying a bow and so on.

Figure 2:
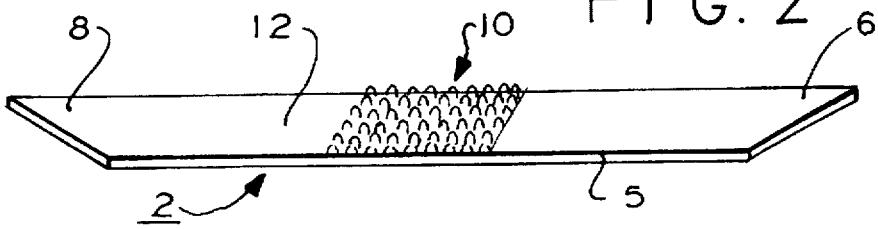
FIGS. 2 and 2*a* are respective isometric and plan views of the device of FIG. 1.
Figure 2A:
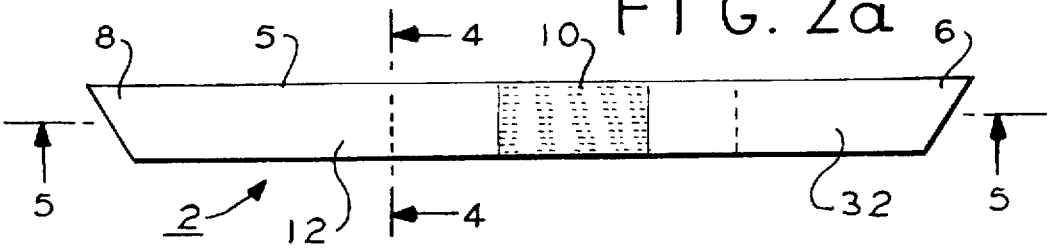

In FIGS. 2 and 2*a*, the member 5 comprises any flat material preferably woven cloth, suede, cotton, polyester, woven or non-woven, leather, synthetic fibers, thermoplastic material or mat or flocked or any other flexible material suitable for wrapping about a hair bundle. The material preferably is imprinted for decorative purposes with a pattern and/or color (not shown).

The shape of the device 2 member 5 illustrated is a preferred form, is generally long relative to its transverse width, e.g. one half inch wide to six inches long, may have inclined ends 6, 8 edges for decorative purposes and which edges and member may take other suitable shapes according to a given implementation. The problem with the material, e.g., fabric and so on forming member 5 is that when wrapped about a bundle of human hair it tends to slip off the hair, becoming undone, due to natural motions and vibrations of the wearer. Typical fabrics and materials employed for tying hair bundles are relatively slippery with respect to typical human hair.

Figure 6:
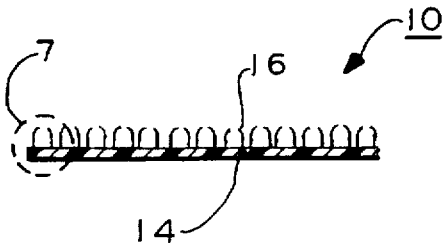
FIG. 6 is a side sectional elevation view similar to that of FIG. 5 showing the hair gripping device in more detail.

To minimize such sliding action, a relatively good hair gripping member 10 is secured to a side surface 12 of member 5, which side surface is generally and preferably flat, but in use is bent or folded into the desired shape. Member 10, FIGS. 6 and 7, comprises a substrate 14 and a plurality of upstanding relative stiff, flexible fibers 16. The fibers 16 are somewhat hook shaped at their upper ends and are secured to the substrate in multiple row arrays. The fibers 16 form a somewhat comb-like arrangement with a plurality of teeth formed by the fibers.

Figure 7:
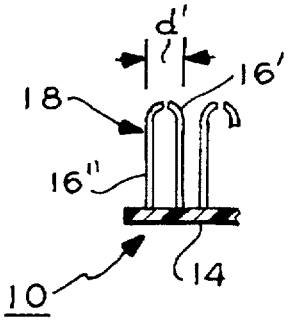
FIG. 7 is a side elevation view of the hair gripping device of FIG. 6 taken at region 7 showing the hair gripping fibers in more detail.

In FIG. 7, for example, one fiber array 18 comprises upstanding fibers 16' and 16". The upper ends of the fibers 16' and 16 curl toward one another. Similar fibers are aligned in a row with fibers 16' and 16" into and out of the drawing figure. The fibers 16 have a length preferably of about 0.10 inches and are of sufficiently small diameter as to be relatively soft and flexible to touch, the fibers being preferably formed of thermoplastic material as is the substrate 14. However, the fibers are pliable and have memory for retaining their shape when bent. The fibers 16 preferably have a uniform spacing d' in two orthogonal directions of about 0.060 inches, but the spacing may be non-uniform and may be at a smaller or greater spacing. The fibers for example may be woven or bonded to the substrate 14. The fibers 16, for example, may comprise loops that are severed at their apices.

The gripping member 10 is available commercially from the Velcro company. The fibers 16 form a hair gripping surface. For purpose of definition, it is intended that the term gripping surface as used herein and in the claims for the gripping member means structure that may have a portion that penetrates to a depth, such as fibers 16, or for example, a miniature comb, for gripping the hair in a bundle. The term gripping surface is not intended to be limited to gripping solely by a flat surface as occurs with a homogeneous solid sheet material.

The gripping member 10 is different than the typical hook and loop type fastener device available from the Velcro company under the Trademark VELCRO. The hook type fastener is typically employed on one substrate for use with mating loop type fasteners on a second substrate and which engage the hooks of the hook type fastener portion. The hooks of such a hook member are shorter, stiffer and more closely spaced than the hook members of the gripping member 10. The gripping member 10 is available from the Velcro Company as a different curler retainer device for holding curlers, i.e., rollers, about which human hair is wrapped, to the wrapped hair. In this use, the hook type curler gripping device is wrapped about the curled hair surrounding the curler. There is no tying or twisting involved to secure the retainer device to the hair.

The present inventor has discovered that a relatively small piece of the VELCRO curler device provides relatively high friction for holding a relatively slippery ribbon member, such as member 5, to a bundle of human hair and will not readily slide relative to the elongated bundle as occurs with other devices. While the Velcro device is preferred, other relatively high friction type materials may also be used in the alternative. These gripping members form a portion of the member 5, for example are about 0.5 to two inches in length. If teeth of a comb, for example, the teeth need only have a length of a fraction of an inch, the length depending upon the diameter of the teeth, such as the fibers 16 discussed above wherein the fibers preferably have a diameter of less than about 0.015 inches for a length of about 0.10 inches.

In FIG. 12, a hair gripping device 20 comprises a rubber sheet substrate 22 formed with raised dimples 24 which may be molded therein. The dimples may be raised a fraction of an inch with a diameter of a fraction of an inch. These dimensions are not important. The substrate 22 is of relatively high friction for friction engaging the hair of bundle 4. In a further alternative, in FIG. 13, a rubber relatively high friction hair gripping member 26 having a smooth surface is bonded to the surface of a hair wrapping member 28, which comprises two juxtaposed fabric or other material layers 30 and 32 bonded together.

Figure 3:
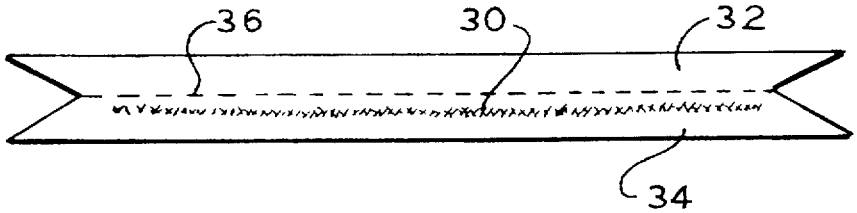
FIG. 3 is a plan view of the device of FIG. 1 in an assembly fabrication stage.

In FIG. 3, to provide a twist tie capability to the device 2, FIG. 1, a preferably metal ductile member 30, e.g., a wire, is sandwiched between two layers 32 and 34 of member 5. A fold line 36 is between the two layers 32 and 34. The fold line is merely to indicate the location of the fold and is physically is not present in a typical fabric as a structural element, the fabric being foldable at this line. The member 30 is formed of ductile metal wire or other materials capable of similar functions described herein. The member 30 is readily manually bendable, but sufficiently stiff so as to have memory and retain any bend position.

Figure 8:
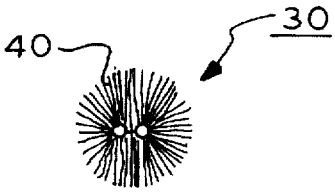
FIG. 8 is an end elevation view of a ductile member used in the embodiment of the present invention.
Figure 9:
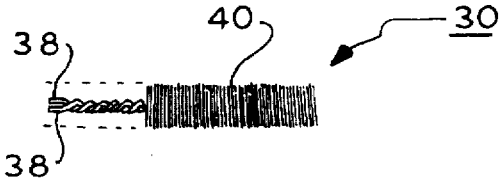
FIG. 9 is a side elevation view of a portion of the member of FIG. 8 with a portion of cushioning fibers removed.

Preferably, the member 30 is formed of a conventional, commercially available pipe cleaner. In FIGS. 8 and 9, the member 30 comprises a pair of twisted ductile wires 38 to which a plurality of fibers 40, plant or synthetic, are secured in the interstices between the wire pair. The fibers form the member 30 into a bendable cushioned structure. In FIG. 9, a portion of the fibers shown in phantom are removed to illustrate the wires 38. the fibers 40 may comprise a flocking material in the alternative.

Figure 4:
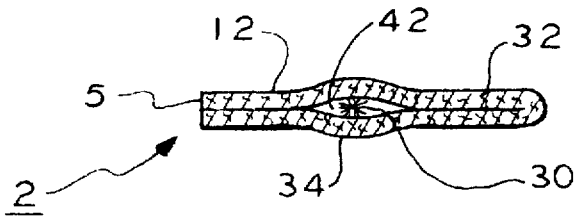
FIGS. 4 and 5 are sectional elevation views of the device of FIG. 2*a* taken along respective lines 4—4 and 5—5.
Figure 5:
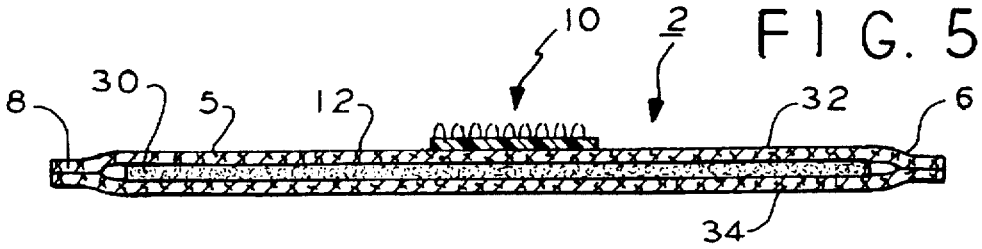

In FIG. 5, member 30 is sandwiched between layers 32 and 34 when the layers are folded at fold line 36, FIG. 3. Member 30 extends for substantially the entire length of member 5 except for a small portion of the ends 6 and 8 which are secured together to lock the ductile member 30 in the cavity therebetween. In FIGS. 3 and 4, a single ductile member 30 is shown. Preferably, the layers 32 and 34 and member 30 are bonded together with a suitable adhesive. In the alternative, the layers 32 and 34 of member 5 may be secured at its edges by stitches,(not shown). This locks the ductile member in the pocket 42, FIG. 4, therebetween.

In use, FIG. 1, the ends of the device 2 are twisted about one another to form a twist locking tie therebetween. The ductile member 30 locks the member 5 in position about the bundle 4, FIG. 1. This is achieved with, for example, a quarter turn twist of the device ends 6 and 8 as shown in FIG. 1. The gripping member 10 holds the device 2 axially in place on the hair bundle 4 without the need for any additional holding devices such as rubber bands, pins, clips, barrettes, conventional bulky and unsightly combs and the like which normally are externally visible in use. The gripping member of the present invention is not generally externally visible during use.

In an alternative embodiment, a plurality of members 30 may be employed as shown by way of example in FIG. 11. In FIG. 11, three bendable ductile members 30 are used in the device 40. the device 40 otherwise is of similar construction as the device 2. Even more or fewer members 30 may also be used. In the implementation in which no members 30 are used, the device 2 member 5 is sufficiently long so that the ends may be knotted or tied together with a bow as described above.

Figure 10:
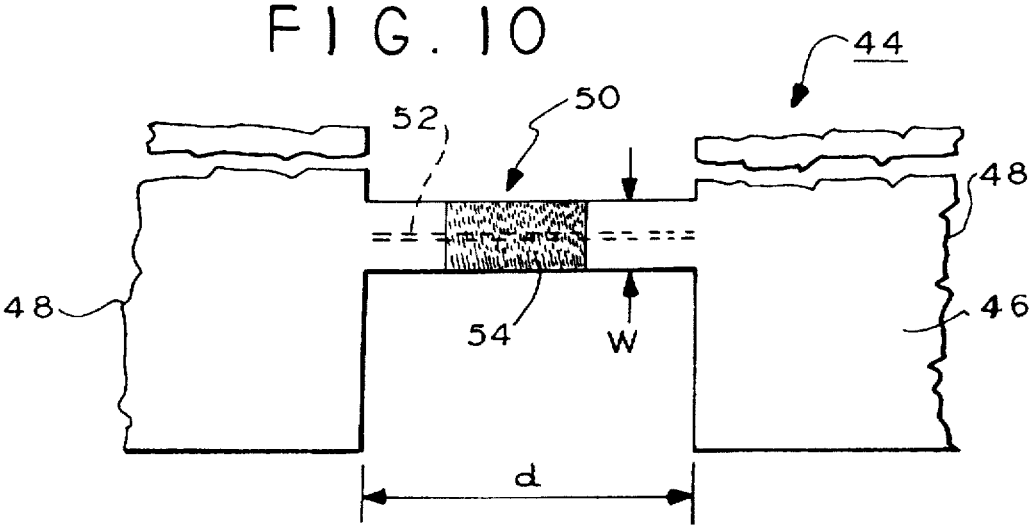
FIG. 10 is a fragmented plan view of a hair retaining device according to a second embodiment of the present invention.

In FIG. 10, an alternative embodiment is shown in which a hair retainer and decorative device 44 is formed of a sheet of decorative fabric 46. The fabric 46 may comprise a single ply and has relatively large rectangular (or other shaped) portions 48 of the same or different dimensions. The portions 48 are joined by a central hair retaining device 50. The device 50 is constructed similarly as device 2 and comprises juxtaposed layers bonded together preferably with a bendable ductile cushioned member 52 sandwiched between the layers. The device may have any length d and width w. The gripping member 54 is medially between the portions 48 and is substantially shorter in length than the device 50, e.g., one to two inch length as compared to five or six inch lengths, respectively. The widths are not important and may have any value suitable for gripping the hair.

It should be understood that modifications may be made by one of ordinary skill and that the illustrated embodiments are given by way of example and not limitation. It is intended that the scope of the invention be defined by the appended claims.

What is claimed is:

1. A hair retaining device for wrapping about and retaining a length of hair in a bundle comprising:

a length of flexible material having first and second ends and arranged to be wrapped about said hair bundle, said material including means for releasably securing said length of material to and about the hair in said bundle, said material having a friction sufficiently low so that the material slides along said bundle length when wrapped and tied; and hair gripping means secured to said material intermediate the ends for gripping the hair in said bundle to resist said sliding;

said gripping means comprising a plurality of relatively stiff, flexible spaced discrete fibers secured to and extending from said material in an array for gripping engagement with said hair in said bundle;

said relatively stiff fibers comprising strands having an end distal said material, said distal ends comprising hook shaped portions.

2. The device of claim 1 wherein said material is formed into multiple juxtaposed layers having an enclosed interior region, further including a bendable ductile member attached to said material and fully enclosed in said interior region for twist tie securing said ends.

3. The device of claim 2 wherein said member comprises a metal wire and a plurality of further fibers secured thereto for cushioning said material in said interior region.

4. The device of claim 2 including a plurality of said members.

5. The device of claim 2 wherein said member includes cushioning means surrounding the member.

6. The device of claim 2 wherein said member comprises a twisted pair of wires and includes a plurality of fibers extending transversely from and secured to the twisted pair of wires.

7. The device of claim 2 wherein the member comprises at least one wire and a cushioning material secured to and surrounding the at least one wire.

8. The device of claim 1 wherein the plurality of relatively stiff, flexible spaced discrete fibers in said array are thermoplastic and form a plurality of teeth secured in multiple row arrays.

9. The device of claim 1 wherein the fibers are thermoplastic of at most about 0.10 inches in length, are sufficiently small in diameter so as to be relatively soft to the touch and have memory to return to their original position when bent.

10. The device of claim 1 wherein the fibers have a diameter of no more than about 0.015 inches.

11. The device of claim 1 wherein the sheet material is cloth.

12. The device of claim 1 wherein the material has a given length, said gripping means extending partially and medially along the given length.

13. A hair retaining device for securing a length of hair in a bundle comprising:

flexible material having a length for wrapping about the bundle and defined by first and second ends, said material arranged to be releasably secured to and about the hair in said bundle;

a ductile member secured to the material to enable twist tying the ends together; and hair gripping means secured to said material intermediate the ends and comprising a plurality of relatively stiff, flexible spaced discrete fibers having curved hook-like ends secured to and extending from said material for gripping penetrating engagement with said hair in said bundle to substantially resist sliding of said material along said bundle length.

14. The device of claim 13 wherein the member is sandwiched between juxtaposed layers of said material.

15. The device of claim 13 wherein the material has a first portion with a transverse width relatively narrow as compared to its length and a second portion extending from each end of said first portion and having a substantially wider transverse width than said first portion, said gripping means being secured to said first portion.

16. A hair retaining device for wrapping about and retaining a length of hair in a bundle comprising:

a length of flexible material having first and second ends and arranged to be wrapped about said hair bundle, said material including means for releasably securing said length of material to and about the hair in said bundle, said material having a friction sufficiently low so that the material slides along said bundle length when wrapped and tied; and hair gripping means secured to said material intermediate the ends for gripping the hair in said bundle to resist said sliding;

said gripping means comprising a plurality of relatively stiff, flexible spaced hooked shaped discrete fibers secured to and extending from said material forming a plurality of teeth secured in an array for gripping engagement with said hair in said bundle.

* * * * *